United States Patent [19]

Wise

[11] 4,423,867

[45] Jan. 3, 1984

[54] BILLIARD CUE WITH LATERAL OFFSET

[76] Inventor: William A. D. Wise, 28 Wollaston Ave., Apt. 17, Wollaston, Mass. 02170

[21] Appl. No.: 459,766

[22] Filed: Jan. 21, 1983

[51] Int. Cl.[3] ..... A63D 15/08

[52] U.S. Cl. ..... 273/68; D21/232

[58] Field of Search ..... 273/68, 69, 2, 14; 272/8 N, 27 R, 27 N; D21/232, 210, 211

[56] References Cited

U.S. PATENT DOCUMENTS

| | | | |
|---|---|---|---|
| 1,279,925 | 9/1918 | Smith | 273/69 |
| 3,220,730 | 11/1965 | Fine | 273/77 |
| 3,834,706 | 9/1974 | Leonhart | 273/122 R |

FOREIGN PATENT DOCUMENTS

| | | | |
|---|---|---|---|
| 1821 | of 1903 | United Kingdom | 273/69 |

*Primary Examiner*—Richard C. Pinkham
*Assistant Examiner*—Matthew Schneider
*Attorney, Agent, or Firm*—Ronald J. Paglierani

[57] ABSTRACT

A billiard cue has a centrally disposed, generally S-shaped member which laterally offsets its conventionally-shaped straight end pieces, yet keeps them in parallel alignment. In a specific embodiment, the S-shaped member is threadably coupled to the mating end pieces, so that the cue can be disassembled to facilitate carrying.

5 Claims, 2 Drawing Figures

BILLIARD CUE WITH LATERAL OFFSET

BACKGROUND OF THE INVENTION

The present invention relates in general to the field of billiard cues, and in particular to those having a modified shape to enhance player flexibility.

The game of billiards, and more particularly pocket billiards or pool, enjoys immense world-wide popularity. Because of its relative simplicity, a person of any age can readily learn the basics of the game, and can play competitively against players of comparable skill. Even when played alone, the game offers many hours of enjoyable recreation.

However, there are certain amounts of manual dexterity and physical maneuverability required for billiards. This is especially true when trying to apply a particular type of "draw" or "English" to the cue ball, or when addressing a cue ball which is closely surrounded by other balls. Therefore, some people to whom the simplicity of the game would otherwise offer special appeal, are unable to adequately cope with this aspect of the game. Such people include those with physical handicaps which limit their mobility, or paraplegics who are confined by the rigid structure of a wheelchair or braces. Even the most accomplished player eventually finds his game deteriorating because of advancing years, possibly because of the onset of arthritis, or even by excess weight in the wrong places.

Therefore, in view of the above, it is an object of the present invention to provide a billiard cue which will compensate for a player's physical immobility, by allowing him to adjust the cue handle to a comfortable position, without affecting the proper placement of the cue tip relative to the ball and the playing surface.

It is a further object of the present invention to permit this compensating feature to be easily fitted to conventional billiard cue structures.

SUMMARY OF THE INVENTION

An embodiment of a billiard cue built in accordance with the present invention includes a substantially straight handle portion and a substantially straight ball-engaging portion, the latter including a resilient ball-contacting tip. An offsetting member, centrally positioned between the handle and the ball-engaging portions, interconnects same. This member laterally offsets the longitudinal axes of the two portions from each other, while maintaining the axes parallel.

In a particularly advantageous embodiment, the offsetting member is a removable, generally S-shaped central section having threaded fasteners at either end, which engage mating threaded fasteners on the handle and ball-engaging portions. In this configuration, the invention is easily adaptable to conventional two-piece billiard cues, which typically are threadably interconnected so that they can be dismantled for easy carrying. If desired, certain amounts of length or weight may be trimmed from the cue, to compensate for that added by the S-shaped section, so that the resulting cue conforms to standard cue dimensions and maintains proper balance. However, experienced players may find that the redistribution of weight and balance caused by the insertion of the S-shaped section produces desirable performance characteristics.

BRIEF DESCRIPTION OF THE DRAWINGS

The novel features and advantages of the present invention will become apparent to those skilled in the art from the following description of the preferred embodiments, in conjunction with the accompanying drawings in which.

DESCRIPTION OF THE PREFERRED EMBODIMENTS

Figure 1:
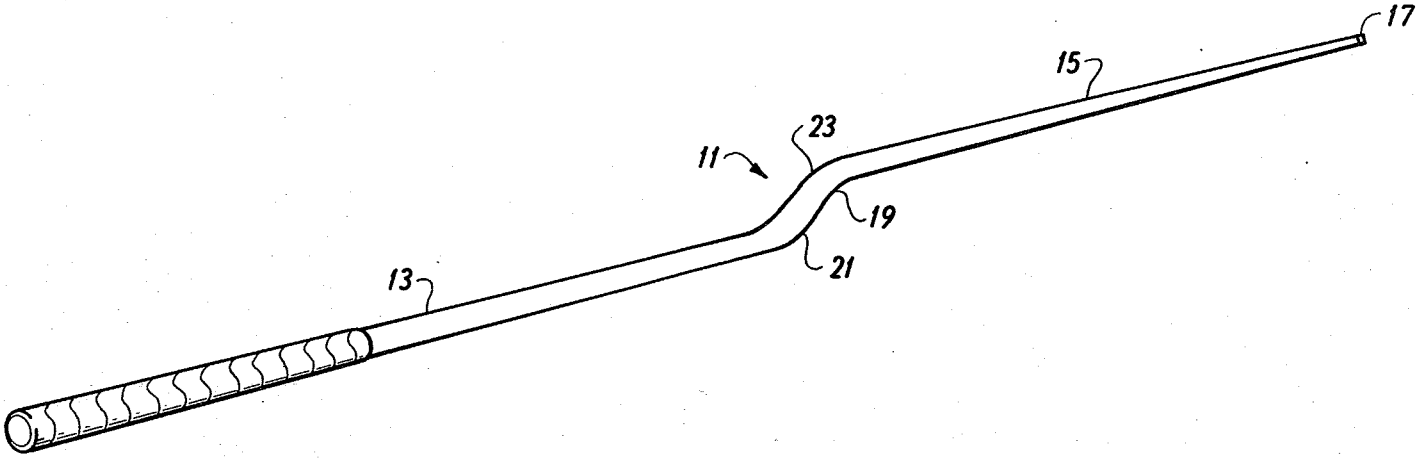
FIG. 1 is a perspective view of a billiard cue built in accordance with the present invention.

Referring to FIG. 1, a billiard cue 11 includes a conventional straight handle portion 13, for gripping by the player, and a straight ball-engaging portion 15. In keeping with conventional billiard cue design, both the handle and ball-engaging portions are gradually tapered along their lengths, with the handle portion being broader overall than the ball-engaging portion. The ball-engaging portion includes a resilient tip 17, typically made of cork or felt, which actually makes contact with a cue ball (not shown). The resiliency of the tip permits greater control over the motion of the cue ball, including the imparting of spin thereto, than would an unyielding substance.

Located approximately halfway between the extreme ends of the cue 11 is an integrally formed offsetting member 19, which links the handle portion 13 and the ball-engaging portion 15 and laterally displaces their respective longitudinal axes from each other, while maintaining these axes in parallel alignment. This member consists of two oppositely curved arcuate sections 21, 23, combined in the general shape of the letter "S". It is appropriately contoured to maintain the desired uniform taper of the cue from end to end, and to present a smooth, continuous surface at the respective interfaces with the handle and ball engaging portions.

The advantage of a billiard cue of this construction is in the added maneuverability it offers to a player of restricted mobility. Proper placement of the cue tip relative both to the playing surface and to the cue ball is crucial to proper control of the cue ball's flight. Generally, it is desirable to keep the cue parallel with the playing surface at all times during the stroke and follow-through. The placement of the cue tip 17 relative to the ball's center of gravity at the moment of impact determines whether any spin is imparted to the ball (in addition to the normal thrust along the intended direction of travel), and if so, in which direction. On the other hand, orienting the cue at an angle to the playing surface, rather than parallel thereto, may be useful in imposing a spin on the ball. Therefore these constraints on the orientation of the ball-engaging portion of the cue, together with the purely linear configuration of the traditional billiard cue, result in similar constraints being imposed on the positioning of the player's hand and arm. Previously, in the case of a player having a physical incapacity which prevented him from moving his hand and arm to the appropriate position, the only viable course of action was to alter placement of the ball-engaging portion of the cue, thereby sacrificing some degree of control.

However, the novel design of the cue of FIG. 1 allows the handle portion 13 to be rotated 360 degrees about the axis of the ball-engaging portion 15, without disturbing the alignment of the ball-engaging portion relative either to the ball or the playing surface. Yet the handle portion can occupy any position within this 360-degree continuum which best accommodates the movements of the player. For example, an arthritic player who cannot comfortably lift his arm above a certain height to accomplish a desired shot, may place the handle portion at its lowest (6 o'clock) position. This maneuver lowers the handle portion below the level of the ball-engaging portion of the amount of the offset, thereby moving the handle portion into a region now easily accessible by the player. Similarly, a player whose lateral movement is impeded by the confines of a wheelchair may move the handle portion to a 9 o'clock or a 3 o'clock position to obtain an advantage. Experience has shown that an offset in the range of approximately two to four inches achieves the desired results without adversely affecting the normal performance characteristics of the cue. However, other amounts of off-set may be found to be useful in certain circumstances.

Figure 2:
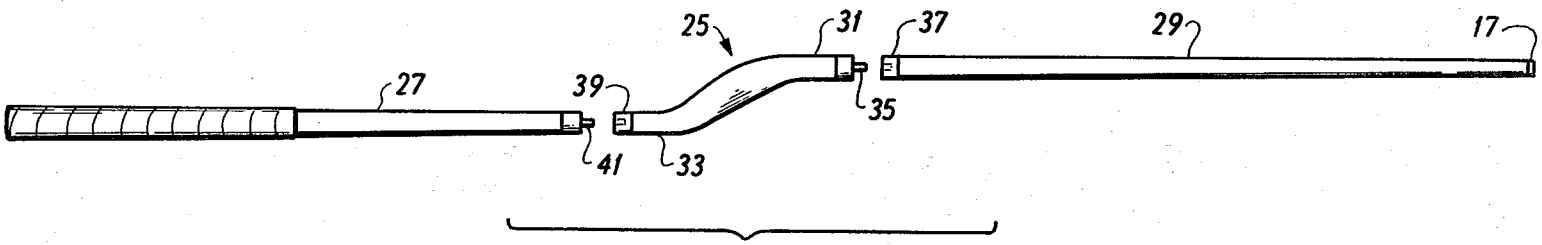
FIG. 2 is an exploded view of a second embodiment of the invention.

Although the entire cue shown in FIG. 1 can be fabricated as an integral unit from a single piece of wood, such an operation may entail an unacceptable waste of material, or an overly complex manufacturing process. Thus, the alternate embodiment shown in FIG. 2 offers certain manufacturing advantages. Here, a separable offsetting member 25, which is made as an individual unit, is inserted between detachable handle and ball-engaging portions 27, 29. As in the embodiment of FIG. 1, the offsetting member is generally in the shape of the letter "S", but with its oppositely directed ends 31, 33 parallel to one another. A threaded male connector 35, fixed to the forward end 31 of the offsetting member, is disposed to engage a mating female receptacle 37 in the straight ball-engaging portion 29. Similarly, a threaded female receptacle 39 fixed to the rearward end 33 is disposed to engage a mating male connector 41 in the straight handle portion 27. After assembly, the handle and ball-engaging portions again are parallel.

Since conventional billiard cues are already available in models in which a threaded connector joins two separable halves (similar to portions 27, 29), the separable offsetting member 25 is especially adaptable to this type of construction. Using threaded connectors which mate with the preexisting connectors on the two cue halves permits the offsetting member to be directly inserted therebetween.

Of course, it may be preferable that the outer surface of the offsetting member blend smoothly into the surfaces of the two straight cue portions at the interfaces therewith. One skilled in the woodworking arts can proportion the offsetting member to the proper shape and dimensions at both ends to achieve this result. If the two halves of the cue are left undisturbed, they can always be assembled directly to each other to restore the cue to its original configuration. In this manner the cue can perform double duty, either as a conventional straight cue, or, with the offsetting member installed, as a laterally offset version. However, purists may wish to trim some length or weight from the offset version of the cue to compensate for that added by the offsetting member, to return the cue to standard length and weight specifications.

In the illustrated embodiments, the offsetting member presents a gradually sloped, S-shaped contour. Nevertheless, the present invention can be achieved using a sharply right-angled offsetting member. However, the abrupt 90-degree bends may become regions of concentrated stress when the cue is forcibly driven into the ball. Since the player applies force directly along the axis of the handle portion, while the ball-engaging portion lies along a parallel, yet offset, direction, an overly abrupt and excessive application of force, combined with the inertia of the cue ball, may fracture the offsetting member at the 90-degree bends. Thus, if such an alternative configuration is to be used, strict attention must be paid to the tensile strength of the material used in the offsetting member, to avoid this undesired result.

Clearly, certain modifications to the disclosed embodiments may become apparent to those skilled in the art, but which do not depart from the spirit of the present invention. It is intended however that such modifications be included within the scope of the following claims.

What is claimed is:

1. A billiard cue, comprising:

a substantially straight handle portion, being smoothly tapered about its longitudinal axis;

a substantially straight ball-engaging portion being smoothly tapered about its longitudinal axis, and including a resilient ball-contacting tip;

a separable offsetting member, centrally positioned and interconnecting said handle and ball-engaging portions, for laterally offsetting the longitudinal axes of said portions from each other, while maintaining said axes parallel, said offsetting member also being contoured so as to match the taper of each of said portions at the respective points of contact therewith; and means for coupling said offsetting member to said handle and ball-engaging portions, including threaded members fixed to the ends of said offsetting member, and threadedly-engaging members fixed to the mating ends of said handle and ball-engaging portions.

2. A billiard cue, comprising:

a substantially straight handle portion, being smoothly tapered about its longitudinal axis;

a substantially straight ball-engaging portion, including a resilient ball-contacting tip, said ball engaging portion also being smoothly tapered about its longitudinal axis; and an offsetting member, centrally positioned between and interconnecting said handle and ball-engaging portions, and contoured so as to match the taper of each of said portions at the respective point of contact therewith, for laterally offsetting the longitudinal axes of said portions from each other, while maintaining said axes parallel.

3. The billiard cue as set forth in claim 1 wherein said offsetting member is separable from said handle and ball-engaging portions, and further comprising means for coupling said member to each of said portions.

4. The billiard cue as set forth in claim 2 wherein said offsetting member is generally S-shaped.

5. The billiard cue as set forth in claim 4 wherein said offsetting member is separable from said handle and ball-engaging portions, and further comprising threaded members fixed to the ends of said offsetting member and threadably-engaging members fixed to the mating ends of said handle and ball-engaging portions, for coupling said offsetting member to each of said portions.

* * * * *

UNITED STATES PATENT AND TRADEMARK OFFICE

CERTIFICATE OF CORRECTION

PATENT NO. : 4,423,867

DATED : January 3, 1984

INVENTOR(S) : William A. D. Wise

It is certified that error appears in the above-identified patent and that said Letters Patent is hereby corrected as shown below:

In claim 3, line 1, delete "1" and substitute --2--.

Signed and Sealed this

*Fifth* Day of *June 1984*

[SEAL]

*Attest:*

GERALD J. MOSSINGHOFF

*Attesting Officer*

*Commissioner of Patents and Trademarks*